United States Patent [19]

Coulson

[11] 4,269,382

[45] May 26, 1981

[54] HEIGHT-ADJUSTABLE REAR VIEW HAIR STYLING MIRROR

[76] Inventor: Blanche E. Coulson, 3720 N. 34 Ave., Omaha, Nebr. 68111

[21] Appl. No.: 105,349

[22] Filed: Dec. 19, 1979

[51] Int. Cl.[3] ..... A47G 1/16

[52] U.S. Cl. ..... 248/472; 350/288

[58] Field of Search ..... 350/288, 297–300, 350/304, 305, 306; 248/472, 469, 467, 460, 441 R, 449

[56] References Cited

U.S. PATENT DOCUMENTS

| | | | |
|---|---|---|---|
| 505,127 | 9/1893 | Ranger | 350/304 |
| 1,779,655 | 10/1930 | Benton | 350/288 |

*Primary Examiner*—Jon W. Henry

*Attorney, Agent, or Firm*—Howard I. Podell

[57] ABSTRACT

A mirror assembly which frees the user's hands and allows viewing the back of the head while using two hands for hair styling purposes, has a mirror attached to a frame with three legs, connected by hinges which allows the frame to close flat for storing against wall. Frame is of such a height as to allow the mirror to free stand in middle of the floor, thus freeing both hands for styling back of hair. The mirror is vertically adjustable on the frame which has a number of spaced holes for hanging the mirror by means of bolt heads extending out from the mirror's frame. The free standing back viewing hair styling mirror is designed to stand alone in the center of the hair dressing area and provides a large angle view of the back of a lady's head with plenty of arm room for styling movement using two hands. The mobility of this assembly enables the person using it to move the mirror from left right-angle viewing to right right-angle viewing easily.

3 Claims, 3 Drawing Figures

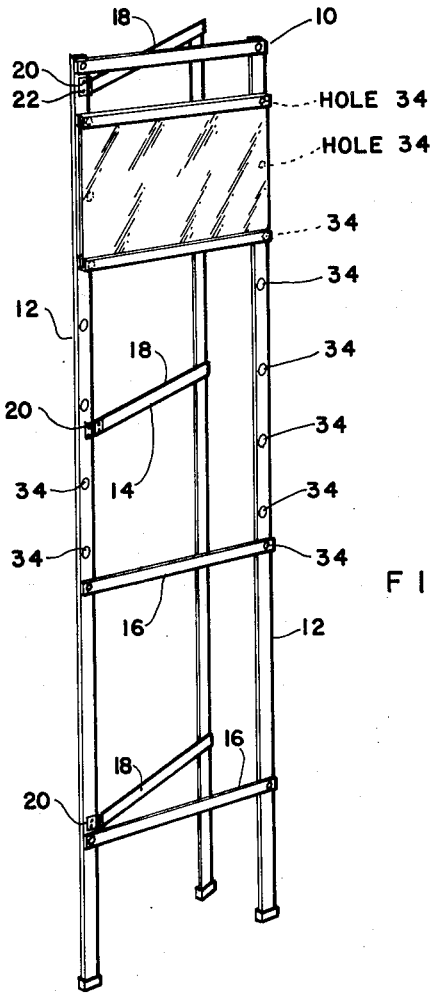
FIG. 1
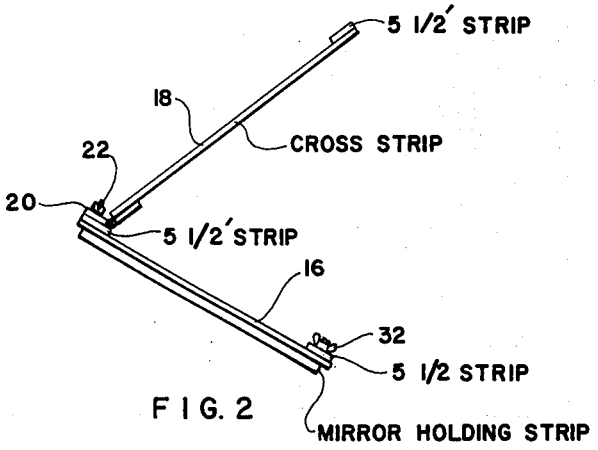
FIG. 2
FIG. 3
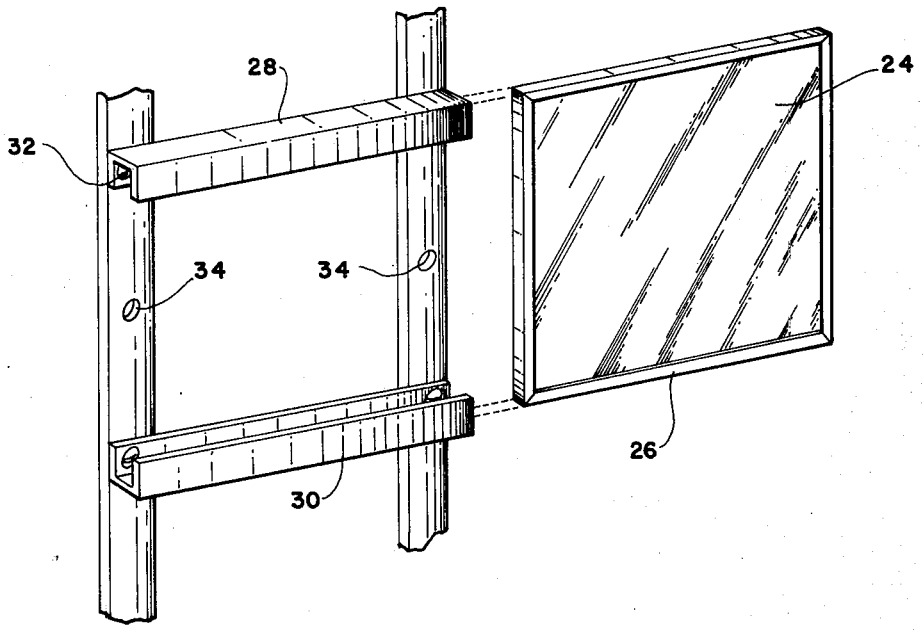

HEIGHT-ADJUSTABLE REAR VIEW HAIR STYLING MIRROR

FIELD OF THE INVENTION

This invention relates generally to a beauty aid mirror assembly which frees a person's hands and allows viewing the back and sides of the head.

DESCRIPTION OF THE PRIOR ART

The prior art, as exemplified by U.S. Pat Nos. 3,905,642; 3,709,585; 3,730,612; 3,072,017; 2,687,674 and 1,451,236 is generally illustrative of the pertinent art but the aforementioned patents are non-applicable to the present invention. While the prior art expedients are generally acceptable for their intended purposes only, they have not proven entirely satisfactory in that they are either complex and expensive to manufacture, or bulky and inconvenient to use, or require unusual dexterity to operate. As a result of the shortcomings of the prior art, typified by the above, there has developed a substantial need for improvement in this field.

The principal object of this invention is to provide a device or article of this character which combines simplicity, strength and durability in a high degree, together with inexpensiveness of construction so as to encourage widespread use thereof.

Other objects of this invention will in part be obvious and in part hereinafter pointed out.

The invention accordingly consists in the features of construction, combination of elements, and arrangement of parts which will be exemplified in the construction hereinafter described, and of which the scope of application will be indicated in the following claims.

SUMMARY OF THE INVENTION

This invention resides in a mirror assembly which frees the user's hands and allows viewing the back of the head while using two hands for hair styling purposes, has a mirror attached to a frame with three legs, connected by hinges which allows the frame to close flat for storing against wall. Frame is of such a height as to allow the mirror to free stand in middle of the floor, thus freeing both hands for styling back of hair. The mirror is vertically adjustable on the frame which has a number of spaced holes for hanging the mirror by means of bolt heads extending out from the mirror's frame. The free standing back viewing hair styling mirror is designed to stand alone in the center of the hair dressing area and provides a large angle view of the back of a lady's head with plenty of arm room for styling movement using two hands. The mobility of this assembly enables the person using it to move the mirror from left right-angle viewing to right right-angle viewing easily.

BRIEF DESCRIPTION OF THE DRAWING

In the accompanying drawing, in which is shown one of the various possible illustrative embodiments of this invention, wherein like reference character identify the same or like parts:

FIG. 1 is an isometric view of the assembly;

FIG. 2 is a top planar view thereof; and

FIG. 3 is a fragmentary view showing attachment of the mirror to the assembly.

DESCRIPTION OF THE PREFERRED EMBODIMENTS

With reference to the drawing, there is shown and illustrated a mirror assembly constructed in accordance with the principles of the invention and designated generally by reference character 10. The illustrated tangible embodiment of the invention includes a frame 12 formed of front and smaller panels members 12, 14 composed of aluminum strips uprights connected by rivets or screws to longitudinal strips 16, 18. Preferably, the uprights constituting the front member 12 are 66 $\times\frac{3}{4}\times\frac{1}{8}$ inches while those forming back member 12 measure 64 $\times\frac{3}{4}\times\frac{1}{8}$ inches. Longitudinal stabilizer strips 16 are $12\frac{1}{2}\times\frac{3}{4}\times\frac{1}{8}$ inches and the back strips 18 measure $11\frac{3}{4}\times\frac{3}{4}\times\frac{1}{8}$ inches.

As shown, the panels are hinged together by hinges 20 secured by suitable fasteners 22 to form a three-legged foldable structure.

FIG. 3 shows shatter-proof acrylic mirror 24 in frame 26 which is adapted to be received in "U"-shaped horizontal brackets 28, 30 measuring $12\frac{1}{2}\times\frac{3}{8}\times\frac{1}{2}\times\frac{3}{8}$ inches, which are each secured to front panel 12 by winged nut and screw 32. A plurality of aligned openings 34 are provided in panel 12 to allow vertical adjustment of brackets 28, 30 and mirror 24.

The assembly can be opened for free standing and closes flat for storing against a wall.

This construction provides for:

1. Easy removal from storage (which could be a $1\frac{1}{2}\times$12 inch area behind a door).
2. No straining because of weight (about $1\frac{1}{2}$ pound weight).
3. Manueverability (can be reset from left right-angle to right right-angle).
4. Large area of back viewing (when facing free standing mirror, view of dressing mirror is approximately 36×36 inches).
5. Stable balancing on legs (hinges allow frame opening on a right angle which gives perfect balance even though $5\frac{1}{2}$ feet high).
6. Allows for easy closing and effortless storage.

The operation and use of the invention hereinabove described will be evident to those skilled in the art to which it relates from a consideration of the foregoing.

The present invention is believed to accomplish among others all of the objects and advantages herein set forth.

Without further analysis, the foregoing will so fully reveal the gist of this invention that those skilled in the art can by applying current knowledge thereto readily adapt it for various applications without omitting certain features which can constitute essential characteristics of the generic or specific aspects of this invention. Therefore, a more lengthy description is deemed unnecessary.

It is intended that various changes may be made in this invention in the practical development thereof, if desired. Such changes are comprehended within the meaning and range of equivalency of the following claims. The invention, therefore, is not to be restricted except as is necessitated by the prior art.

Having thus described the invention, what is claimed as new and to be secured by Letters Patent is:

1. A rear view hair styling mirror, comprising, a front panel, a smaller and narrower rear panel foldably hinged thereto; a frame movably mounted on said front panel and a mirror slidably received in said frame.

2. The invention as recited in claim 1, wherein said panels consist of upright metal members connected by longitudinal supporting strips.

3. The invention as recited in claim 1, wherein said frame consists of oppositely facing generally "U"-shaped brackets.

* * * * *